United States Patent [19]

Cunningham

[11] 4,191,875

[45] Mar. 4, 1980

[54] FAN SPEED CONTROL USED IN INDUCTION COOKING APPARATUS

[76] Inventor: Ronald J. Cunningham, 320 Patrician Way, Pasadena, Calif. 91105

[21] Appl. No.: 850,297

[22] Filed: Nov. 10, 1977

[51] Int. Cl.[2] ..... H05B 9/02

[52] U.S. Cl. ..... 219/10.49 R; 219/10.77; 219/494; 219/510; 363/123; 307/252 B; 336/60

[58] Field of Search ..... 219/10.49, 10.75, 10.77, 219/343, 492, 494, 497, 501, 510; 307/252 B, 252 N, 252 W; 336/55, 59, 60, 61; 363/123, 141; 323/22 SC

[56] References Cited

U.S. PATENT DOCUMENTS

| | | | |
|---|---|---|---|
| 3,163,366 | 12/1964 | Schraith et al. | 219/343 |
| 3,439,183 | 4/1969 | Hurst | 307/252 B |
| 3,548,157 | 12/1970 | Lauck | 219/501 |
| 3,745,382 | 7/1973 | Hoge et al. | 307/252 B |
| 3,786,233 | 1/1974 | Bumpus et al. | 219/343 |
| 3,804,968 | 4/1974 | Mosser | 219/10.49 |
| 4,029,926 | 6/1977 | Austin | 219/10.49 |

FOREIGN PATENT DOCUMENTS

| | | | |
|---|---|---|---|
| 2340513 | 10/1977 | France | 219/10.49 |

OTHER PUBLICATIONS

Galloway, "Using the Trial for Control of AC Power", GE Applications Note 200.35, 3/66.

*Primary Examiner*—Bruce A. Reynolds
*Assistant Examiner*—Philip H. Leung
*Attorney, Agent, or Firm*—Edward D. O'Brian

[57] ABSTRACT

A cooking apparatus employing induction heating is normally constructed so as to utilize a metal housing supporting a cook top upon which there is located at least one induction heating coil. The housing normally contains an electronic "package" for use in supplying power to the coil or coils used and a fan for circulating air through the housing so as to maintain the temperature of the electronic components employed sufficiently low that they will not be damaged by heat. In the disclosed apparatus a thermistor is mounted on the housing adjacent to the wires connecting the electronic components to the heating coil or coils used. This thermistor is used to control the flow of current through an SCR or a triac acting as a switch in a circuit containing the fan motor.

8 Claims, 3 Drawing Figures

FAN SPEED CONTROL USED IN INDUCTION COOKING APPARATUS

BACKGROUND OF THE INVENTION

The invention disclosed in this specification is primarily directed to controlling the operation of an electric fan employed for cooling purposes in cooking apparatus employing induction heating. Although the invention is specifically directed toward the utility indicated in the preceding sentence it is considered that it can be utilized in various other different, somewhat related applications.

A cooking apparatus or so-called "cook top" utilizing induction heating for cooking purposes is normally constructed so as to utilize a metal housing supporting a glass or other cook top upon which there are located a number of induction heating coils. The housing normally contains what may be referred to as an electronic "package" for use in supplying electric power to the coils used. This package of course consists of a group of interconnected electronic components. The package is normally connected to the coils used by wires which are mounted within the housing so as to extend from the electronic package to the various individual coils employed.

In order for such apparatus to operate for a prolonged period without breakdown it is necessary to utilize a fan which circulates air throughout the interior of the housing so as to maintain the temperature of the electronic components employed sufficiently low so that any heat buildup within the housing will not damage such components. Normally such a fan is connected into the circuit used to supply power to the electronic components so as to be automatically turned on each time the cooking apparatus itself is turned on and so as to be turned off each time the cooking apparatus is turned off.

While the use of a fan in this manner is desirable in preventing heat caused damage to the electronic components employed, it is also considered disadvantageous. When a fan is used in the noted manner the apparently inevitable noise associated with fan operation will be present whenever a cooking apparatus of the type indicated is used. To many individuals this is objectionable. Further, the use of a fan in the manner noted is considered unnecessary since such use does not take into consideration whether or not there is heat buildup present within a housing as noted.

As a result of these considerations it is considered that there is a need for improvement in connection with the utilization of a fan in induction heating equipment corresponding to equipment as indicated in the preceding discussion. Although it is possible to fulfill this need through the use of thermostats and various related, known temperature sensing apparatus for controlling the flow of current in an electrical circuit, it is considered that such known expedients are undesirable for any of a variety of reasons. Included within such reasons are the factors of effectiveness, cost and reliability.

BRIEF SUMMARY OF THE INVENTION

An objective of the present invention is to provide new and improved fan speed control in connection with electrically operated heating apparatus. More specifically the invention is intended to provide an induction cooking apparatus such as a so called "cook top" as indicated in the preceding discussion employing induction heating and employing a means for controlling a fan used in such apparatus in accordance with the operation of a heating coil or coils in such an apparatus. Further objectives of the invention are to provide apparatuses as indicated in the preceding discussion of a relatively simple, relatively inexpensive, effective character capable of prolonged utilization with a minimum of maintenance.

In accordance with this invention these objectives are achieved by providing in a heating apparatus employing an induction heating element, electronic means for controlling the operation of said heating element, wire means connecting said heating element with electronic means for supplying power to said heating element, and an electric fan for cooling said electronic means, the improvement which comprises: switch means for controlling the operation of said electric fan independently of the operation of said heating element, heatable means capable of being heated by the passage of power through said wire means located adjacent to said wire means, and temperature sensing means including a sensing element located adjacent to said heatable means so as to be heated by said heatable means as said heatable means is heated when current flows through said wire means.

In the preferred utilization of the present invention the switch means indicated in the preceding paragraph is an SCR connected to the fan so as to control the flow of current through the fan motor. If desired a bidirectional triode thyristor or triac may be used as the switch means. The temperature sensing means employed in this preferred utilization includes a thermistor and a capacitor connected in series network across the SCR or the triac.

BRIEF DESCRIPTION OF THE DRAWING

The invention is best more fully described with reference to the accompanying drawing in which.

Figure 1:
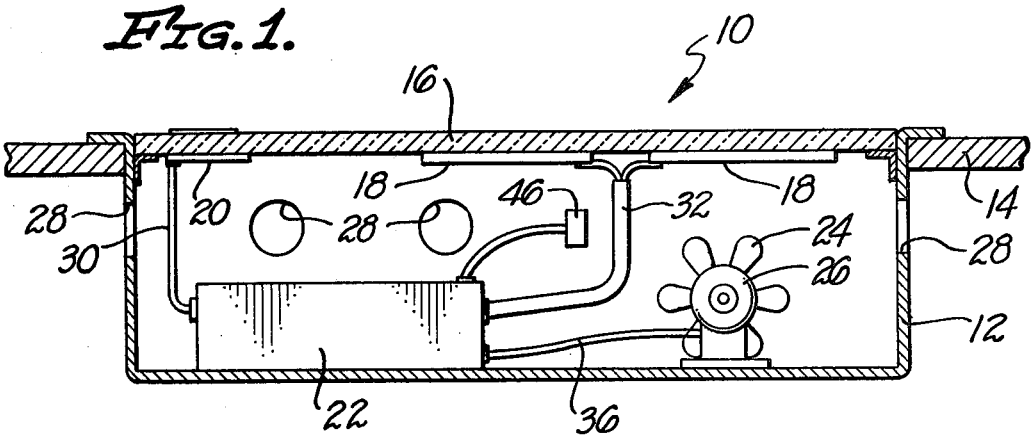
FIG. 1 is a cross-sectional view indicating in a diagrammatic manner an induction cooking apparatus employing fan speed control in accordance with the invention described herein.

It is to be understood that the invention is not to be considered as being limited to a precise apparatus and/or a precise circuit as illustrated in the drawing. The invention itself involves certain essentially intangible concepts or principles as are set forth and defined in the appended claims forming a part of this specification. It will be apparent to those skilled in the art of circuit design that these concepts or principles can be employed in a number of different manners.

DETAILED DESCRIPTION

In the drawing there is shown an induction cooking apparatus 10 in accordance with this invention. This apparatus 10 includes a metal, such as iron, housing 12 supported upon a counter top 14 such as is found in a kitchen. The housing 12 carries a nonmetallic top sheet 16, such as a glass sheet. On the undersurface (not separately numbered) of the sheet 16 there are located several flat, pancake-like induction heating coils 18. If desired, appropriate touch controls 20 for use in operating the apparatus 10 and the coils 18 may also be located on the sheet 16.

Within the housing 12 there is preferably located what may be referred to as an electronic "package" 22 for use in operating the various coils 18. This package 22 preferably includes various components as are described in the Cunningham U.S. Pat. No. 3,637,970 issued Jan. 25, 1972, entitled "INDUCTION HEATING APPARATUS", and the Cunningham U.S. Pat. No. 3,823,297 issued July 9, 1974, entitled "LOAD CONTROLLED INDUCTION HEATING." In the interest of brevity the entire contents of these patents are incorporated herein by reference. This package 22 obviously includes a number of different components which are not separately identified herein. To avoid these components being heated as the coils 18 are operated, it is located remote from the coils 18.

Because such components would be damaged if heated significantly a fan 24 is located within the housing 12. This fan 24 includes a conventional electric motor 26 and is used to circulate air both in and out of the housing through various openings 28 provided in the housing 12 for air circulation purposes. With the disclosed structure the touch controls 20 are connected to the package 22 through the use of appropriate wires 30 extending through the interior of the housing 12 and in turn this package 22 is connected to the various coils 18 through the use of other wires 32 which are mounted along the interior of the housing in close proximity to this housing 12.

Figure 2:
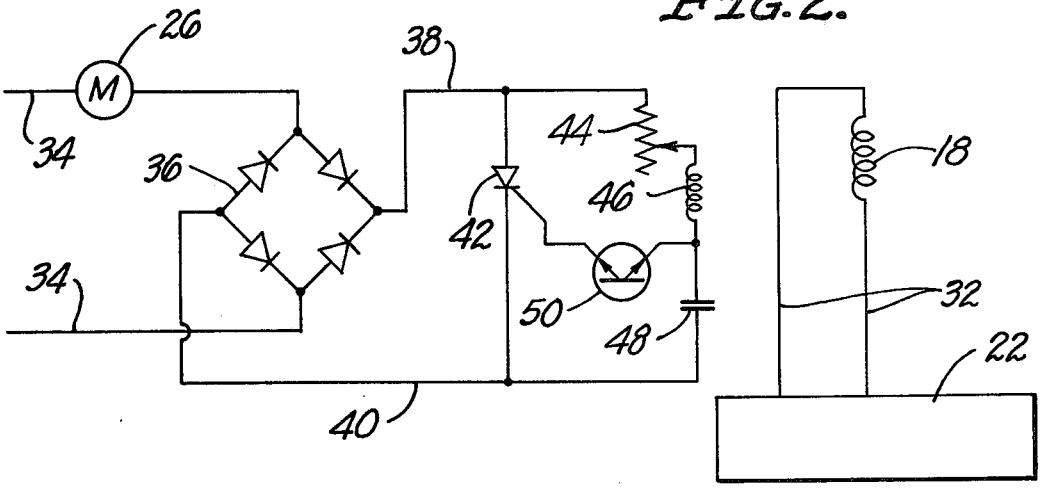
FIG. 2 is a circuit diagram indicating a preferred circuit utilized to accomplish fan speed control in this apparatus.

The motor 26 of the fan 24 is preferably controlled utilizing various components as are hereinafter described which are illustrated in FIG. 2 and which are mounted within the package 22. The motor 26 is in one of two lines 34 connected to an appropriate source of AC power within the package 22. These lines 34 are connected to a conventional four-sided rectifying bridge 36 which is intended to provide a DC current to two different lines 38 and 40. An SCR 42 is connected between the two lines 38 and 40 in parallel with a network consisting of a variable resistor 44 and a thermistor 46 and a capacitor 48. A bilateral trigger diode or diac 50 is connected between the gate of the SCR 42 and between the thermister 46 and the capacitor 48.

This thermistor 46 is located within the housing 12 away from the package 22 adjacent to the wires 32 leading from the package 22 to the individual coils 18 as schematically indicated in connection with one of these coils 18 in FIG. 2 of the drawing. Because of the location of the thermistor 46 in proximity to the wires 32 and the housing 12 whenever power is supplied from the package 22 to one or more of the coils 18 there will be some heating of the housing 12 and this will cause heating of the thermistor 46 so as to change its resistance. This induction heating of the wall of this housing 12 will provide adequate control so that the thermistor 46 can be effective for its intended purpose within the circuit described.

As this circuit as shown in FIG. 2 is utilized the applied power will be rectified and utilized so as to charge the capacitor 48. The rate at which the capacitor 48 is charged will be set by the resistance of the thermistor 46 and of course the resistance of the potentiometer 44. This potentiometer 44 may be manually adjusted so as to vary this rate. In this circuit the diac 50 serves as a means for determining when the capacitor 48 is charged to a predetermined voltage. It serves as a constant threshold device for firing the SCR when the capacitor 48 becomes charged. When the SCR 42 does become conductive, the capacitor 48 will discharge and a current will of course flow through it and this will serve to operate the fan motor 26. When the capacitor 48 is not charged the SCR 42 will not be operative so as to pass a current and the fan motor 26 will not be operated.

Figure 3:
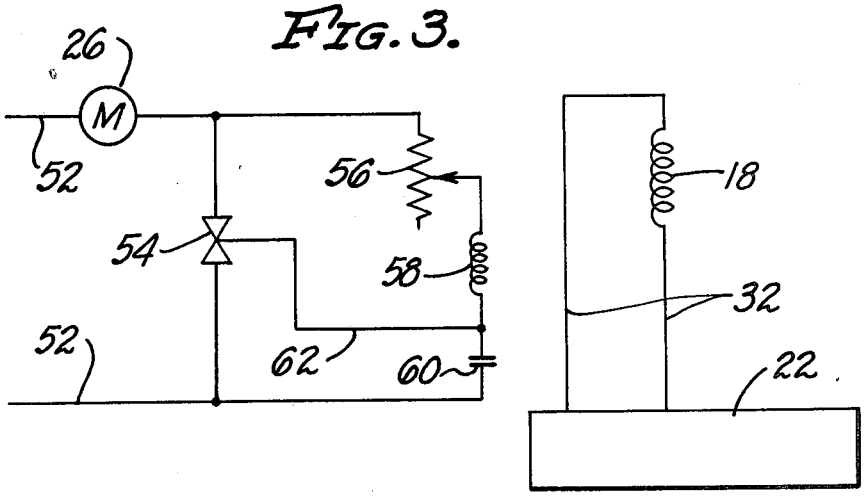
FIG. 3 is a circuit diagram indicating a modified circuit for the same purpose.

In FIG. 3 there is shown a modified circuit which may be utilized in place of the circuit illustrated in FIG. 2. The circuit shown in FIG. 3 utilizes lines 52 which are connected to an appropriate source of AC power within the package 22 described in the preceding. One of these lines 52 contains the motor 26. A bidirectional triode thyristor, or triac, is connected across these lines 52 in parallel with a network consisting of a variable resistor 56, a thermistor 58, and a capacitor 60. The gate of the triac 54 is connected by a line 62 between the thermistor 58 and capacitor 60.

The circuit illustrated in FIG. 3 in many respects works as the previously described circuit illustrated in FIG. 2. When power is supplied in the lines 52 the capacitor 60 will be charged at a rate set by the resistance of the thermistor 58 and the resistance of the resistor 56. The resistor 56 may be adjusted so as to vary this rate. When the capacitor 60 is charged to a predetermined voltage the triac 54 will be rendered conductive. When this occurs of course current will flow through the fan motor 26 and the capacitor 60 will be discharged.

With both of these circuits illustrated in FIGS. 2 and 3 the passage of a current of a type necessary to power an induction heating coil 18 as described will serve to heat the housing 12 adjacent to the wires 32 used in connection with the power being supplied to a coil 18. With the described structure all of the wires 32 used to power all of the coils 18 are grouped together adjacent to the housing 12 so that this housing 12 will become heated in an amount which will vary depending upon the rate at which a particular coil 18 is being powered for induction heating purposes and which will also depend upon the number of the coils 18 which are being simultaneously supplied with electric power for induction heating purposes.

The thermistors 46 and 58 employed are located where the various wires 32 are together adjacent to the housing 12 and are located upon the housing so that such heat as is generated in the housing 12 serves to heat these thermistors 46 and 58 to various extents as indicated in accordance with the currents which are supplied to one or more of the coils 18. Such heating of the thermistors 46 or 58 of course effects circuit performance as indicated in the preceding.

Such heating as is accomplished with the described circuit enables these circuits to in effect set an "average" temperature for an entire apparatus by operating the fan motor 26 in accordance with the number of coils 18 which are being used and the manner in which these coils 18 are being operated. The entire apparatus 10 can be "turned on" with circuits as described without the fan 24 being operated when none of the coils 18 are being powered to an extent sufficient to cause heating of the housing 12. This is considered quite desirable in minimizing fan noise.

With the described structures the housing 12 is in effect a heatable means capable of being heated with the passage of power through the wires 32. If desired the wires 32 used may be spaced from the housing 12 as they extend from the package 22 to the coils 18. When the wires 32 are spaced in this manner a small piece of metal is located adjacent to the wires 32 between the coils 18 and the package 22 so as to serve as such a means. Preferably such a piece of metal is an iron ring (not shown) extending around all of the wires 32. With this type of structure a thermistors, such as either of the thermistors 46 and 58, is mounted on such a small piece of metal.

In both of the described circuits illustrated in FIGS. 2 and 3 different elements are used which in effect operate as electronic switch means for controlling the operation of the fan motor 26. In the circuit shown in FIG. 2 the SCR 42 serves as such switch, while in the circuit shown in FIG. 3 the triac 54 serves as such a switch. The network consisting of the variable resistor 44, the thermistor 46 and the capacitor 48, and the corresponding network consisting of the variable resistor 56, the thermistor 58 and the capacitor 60 both serve as a temperature sensing means. In these two networks the thermistors 46 and 58 both serve as temperature sensing elements which are located adjacent to the "heatable means" identified in the preceding.

I claim:

1. In a heating apparatus employing a plurality of induction heating elements, electronic means for controlling the operation of said heating elements, wire means connecting said heating elements with said electronic means for the purpose of supplying power to said heating elements and an electric fan for cooling said electornic means, the improvement which comprises:

heatable means inductively heated by the passage of current through said wire means and located adjacent to said wire means intermediate said electronic means and said heating elements, temperature sensing means including a sensing element located adjacent to said heatable means, and switch means responsive to said temperature sensing means for controlling the operation of said electric fan independently of the operation of said heating elements and at a variable speed proportional to the degree of induction heating of said heatable means.

2. A heating apparatus as claimed in claim 1 wherein:

said heatable means is located sufficiently far from said heating element so as not to be heated by said heating elements.

3. A heating apparatus as claimed in claim 1 wherein:

said heatable means comprises a body of metal located adjacent to said wire means.

4. A heating apparatus as claimed in claim 3 wherein:

said body of metal is an iron housing for said heating apparatus.

5. A heating apparatus as claimed in claim 1 wherein:

said body of metal is an iron housing for said heating apparatus, and said sensing element is located on said housing.

6. A heating apparatus as claimed in claim 1 including:

a metallic housing, a portion of said housing serving as said heatable means, a cooking surface mounted on said housing, and wherein said heating elements are induction heating coils mounted on said surface, said electronic means are mounted within said housing remote from said heating elements, said wire means are located within said housing adjacent to a wall of said housing, said sensing element is located within said housing remote from said electronic means and said heating elements on said housing so as to receive heat from said housing as said housing is heated by current passing through said wire means.

7. A heating apparatus as claimed in claim 6 wherein:

said switch means comprises an SCR, said temperature sensing means comprises a network including a variable resistor, a thermistor, and a capacitor in series with one another, said network being connected in parallel across a power source with said SCR, said thermister being said sensing element, and including a diac connected between the gate of said SCR and to said network intermediate said capacitor and the other elements of said network.

8. A heating apparatus as claimed in claim 6 wherein:

said switch means comprises a triac, said temperature sensing means comprises a network including a variable resistor, a thermistor, and a capacitor in series with one another, said network being connected in parallel across a power source with said triac, said thermistor being said sensing element, the gate of said triac being connected to said network between said capacitor and the other elements of said network.

* * * * *